US005466209A

United States Patent [19]

Takegawa et al.

[11] Patent Number: 5,466,209

[45] Date of Patent: Nov. 14, 1995

[54] CIGARETTE FILTER-ROD MANUFACTURING DEVICE

[75] Inventors: Masaharu Takegawa, Osaka; Motoharu Kotani, Nagano; Hiromu Yokota, Sakai, all of Japan

[73] Assignee: Daicell Chemical Industry Co., Ltd., Sakai, Japan

[21] Appl. No.: 140,212

[22] Filed: Oct. 21, 1993

[30] Foreign Application Priority Data

Oct. 21, 1992 [JP] Japan ..... 4-307627

[51] Int. Cl.[6] ..... B65H 59/18

[52] U.S. Cl. ..... 493/4; 493/24; 493/29

[58] Field of Search ..... 493/4, 44, 45, 493/47, 49, 24, 29, 39

[56] References Cited

U.S. PATENT DOCUMENTS

| | | | |
|---|---|---|---|
| 4,511,420 | 4/1985 | Arthur | 493/4 |
| 4,699,606 | 10/1987 | Whitley et al. | 493/4 |
| 4,724,429 | 2/1988 | Millen et al. | 493/4 |
| 5,116,298 | 5/1992 | Bondanelli et al. | 493/4 |
| 5,234,397 | 8/1993 | Wahle et al. | 493/4 |
| 5,284,164 | 2/1994 | Andrews et al. | 493/4 |

*Primary Examiner*—Jack W. Lavinder
*Attorney, Agent, or Firm*—Lackenbach Siegel Marzullo Aronson & Greenspan

[57] ABSTRACT

The object of the present invention is to provide a low-priced automatized weight control device for filter-rods, able to be easily installed in present manufacturing facilities and to be operated easily without any need of special equipment or special operating qualifications.

The automatized weight-control device is comprised of a tension gauge measuring the tension in the tow in the first processing step of the tow manufacturing process, and a weight control system to regulate the second processing step to keep the tension in the tow at the specified constant value by increasing the speed of the pretension rollers through the microcomputer by applying the signals transmitted from the tension gauge.

3 Claims, 5 Drawing Sheets

CIGARETTE FILTER-ROD MANUFACTURING DEVICE

BACKGROUND OF THE INVENTION

The present invention relates to a cigarette filter-rod manufacturing device.

Up to the present, a conventional cigarette filter-rod manufacturing device is composed as shown in FIG. 7, in which a tow (namely, acetate fibre flux) 101 is drawn out from a tow bale 102, and taken in a tow processing device 105 from a pair of pretension rollers 104 through a guide arm 103 located above the tow bale 102. In the tow processing device 105, the first processing step stretches the tow 101 towards a specified direction between a pair of pretension rollers 104 and a pair of feed rollers 106, and the second processing step relaxes the tow 101 within a specified ratio between the pair of feed rollers 106 and a pair of delivery rollers 107. The tow 101 treated to the above processes is fed into a rod-making device 108 after adding plasticizer. In this rod-making device, the tow 101 is wrapped with a wrapping paper 110 while being shaped like a rod, and results in a long continuous rod body 109. Then, the rod body 109 is cut to the specified length, then fed into the (not shown) filter packing device, and at last a packing case filled with the cut filters is continuously produced.

At a manufacturing site or an inspection room, it is confirmed whether the filter-rod produced in accordance with the above-mentioned process is within the specified standard values for characteristic properties such as weight, pressure drop and circumference for a fixed interval.

If the checked values of the tow are in the upper or lower standard range, the manufacturing conditions are finely regulated and conditions are reset so that the produced filter-rod may come in the middle value of the specified standard.

In the above quality control process, an operator generally samples the filter-rods at fixed intervals, measures the weight of the filter-rods and finely regulates the manufacturing conditions by hand in respect to the measured results so that the quantity of the tow 101 taken in the manufacturing device is kept at a specified constant value.

However, as the above-mentioned quality control process is a comparatively simple operation, and it is preferable to automize said process to stabilize the quality of filter produced, and another quality control process adopting some automatized control has been practiced.

In such an automatized process, generally B rays are penetrated in the running rod body 109 in the rod-making device 108, and the penetrated does are continuously measured, then the speed at which the tow 101 is taken in is automatically regulated so as to keep the amount of penetrated B rays at a specified constant value.

However, the quality control process using manual operation requires some degree of operator experience and is apt to result in a drop in operating efficiency and stable quality filter-rods.

In employing the above automatized quality control process, it is also necessary to prepare an effective radioactive ray-processing facility and provide operators qualified to handle radioactive rays. Such a facility cannot be easily installed into existing facilities, which increases costs substantially and necessitates the employment of experienced and qualified additional personnel.

The present invention was developed in consideration of the above noted drawbacks, and its object is to provide a cigarette filter-rod manufacturing device having an automatized control device for regulating filter-rod weight, able to reduce installation and running costs and to be easily installed in already existing manufacturing facilities without requiring any special facilities or additional qualified personnel for operating the control device.

SUMMARY OF THE INVENTION

For attaining the above-described object, the tow processing device which performs the first processing step, namely, taking a tow into the tow processing device from pretension rollers through a guide located over the tow bale and stretching the tow toward the specified direction between the pair of pretension rollers and a pair of feed rollers, and which performs the second processing step of relaxing the tow in the specified ratio between the pair of feed rollers and a pair of delivery rollers, is characterized by having a tension gauge which measures the tension in the tow in the first processing step, and a control system for regulating the tension of the tow in the first processing step within a specified constant value by increasing the speed of the pretension rollers by applying the signals transmitted from the tension gauge through the microcomputer.

The present invention is constructed as described above; the degree of tow stretching in the first processing step performed between a pair of pretension rollers and a pair of feed rollers is measured by the tension gauge. The strains in the tension gauge are then converted into electric signals, and finally the revolving speed of the pretension rollers is regulated. As the revolving speed of the feed rollers is kept constant, by increasing the revolving speed of the pretension rollers the tow amount drawn into the first processing step is also increased. Accordingly, by applying this amount, it becomes possible to control the constancy of tow stretching between the first processing step.

Accordingly, if the degree of tow stretching in the first processing step remains constant, the amount of tow which is taken in per unit time becomes constant, and as a result it becomes possible to obtain cigarette filter-rods having a uniform specified weight.

DETAILED DESCRIPTION OF THE INVENTION

Figure 1:
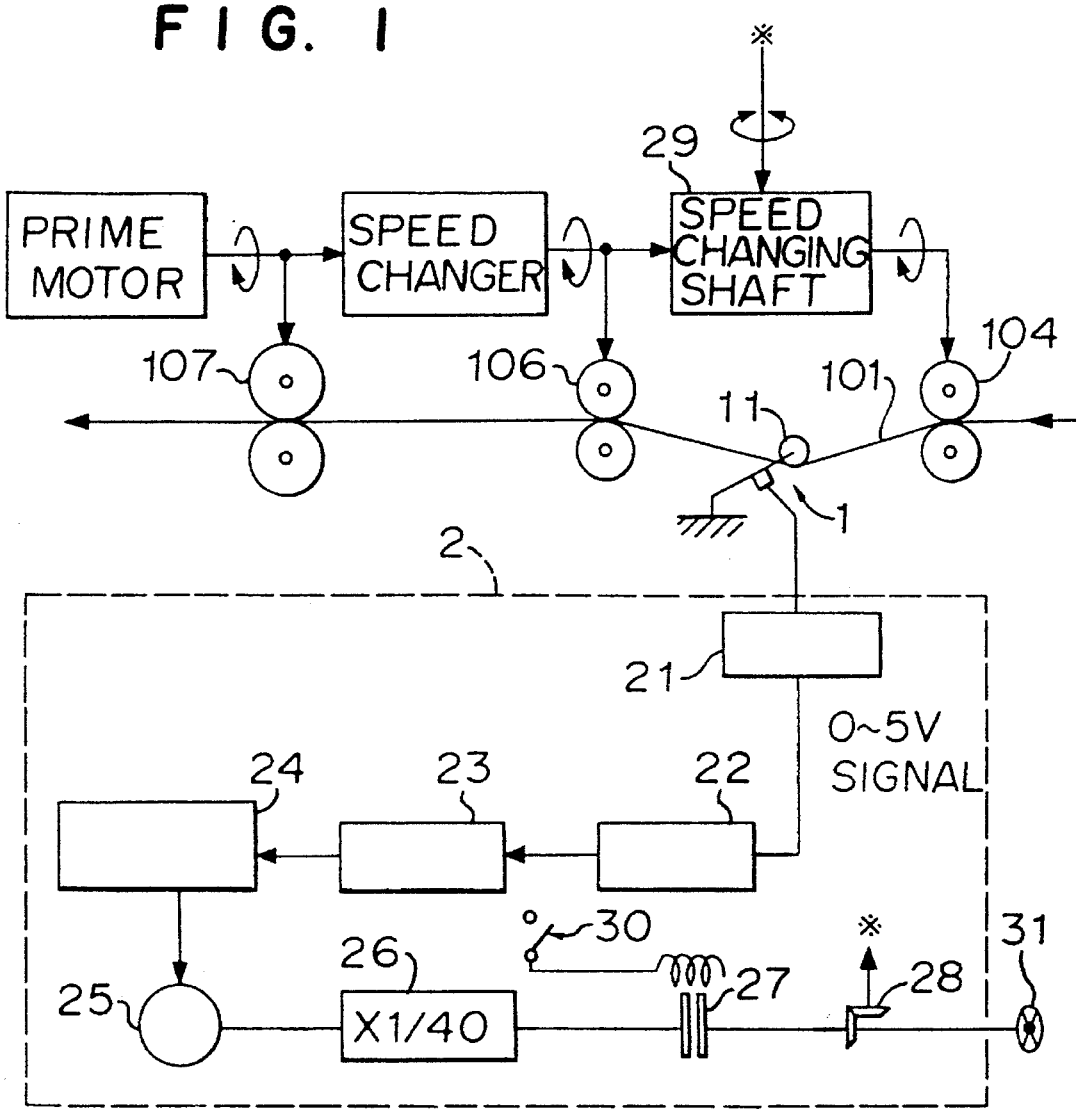
FIG. 1 shows an electrical circuit for the filter-rod automatic weight controller according to the present invention.

The present invention is described in detail with reference to a preferred embodiment shown in the drawings as follows.

FIG. 1 is an electric circuit diagram of the automatized weight control device for cigarette filter-rods, and this device is installed in the first processing step of the tow processing device 105 in a conventional cigarette filter-rod manufacturing device 100.

Namely, this weight control device is composed of a tension gauge 1 attached closely to a tension bar 11 contacted to a tow 101 running between a pair of pretension rollers 104 and a pair of feed rollers 106, and a control system 2 regulating the tension in the tow 101 passing in the first processing step, at the specified constant value by increasing the velocity of the pretension rollers 104 by applying the electric signals converted from the strains of the tension bar 11, through a microcomputer. This control system 2 is also composed of:

a load cell 21 transforming the strain of the tension gauge 1 to the electrical signal, an A-D converter 22 converting the analogue signal of the load cell 21 into the digital signal, the microcomputer 23 storing the control program composed with the pre-obtained results in the below-mentioned experiments, a pulse motor controller 24 activated by the direction of the microcomputer 23, a pulse motor 25 controlled by the pulse motor controller 24, and a driving system enabling variation of the revolving speeds of the pretension rollers 104 and the other rollers by activating speed changers 29 through the pulse motor 25 driven by directions issued from the pulse motor controller 24, a speed reduction gear 26, an electromagnetic clutch 27 and a connecting gear 28.

Also in FIG. 1, the numeral 30 is a switch for changing from manual operation to automatized operation, and the numeral 31 shows a hand-operated speed-changing knob.

When the tension in the tow 101 becomes higher and the strain of the tension gauge 1 consequently becomes larger, in the first processing stage the driving system begins to activate so as to accelerate the speed of the pretension rollers 104 to increase the amount of the tow taken in the rollers, and to keep the tension in the tow at the specified constant value by the control program stored in the microcomputer 23.

In this case, the control program stored in the microcomputer 23 has been previously composed by applying the results obtained experimentally.

In the conventional cigarette filter-rod manufacturing machine 100, as the tow 101 has been crimped, then in drawing the tow 101, the crimp of the tow 101 is extended in accordance with the degree of the loading. Accordingly, the crimp existing in the tow 101 is stretched by receiving the load described as follows when taken in the tow processing device 105 of the conventional cigarette filter-rod manufacturing machine.

Namely, though the tow 101 drawn out from the tow bale 102 is taken in the tow processing device 105 through a guide arm 103 positioned above the tow bale 102, in this case there occurs a drawing resistance on the surface of the tow bale 102 against the drawing force for taking in the tow 101, and as a result the presented crimp in the tow 101 is stretched in some measure so that some tensile force acts on the tow 101. In this case, the tensile force is almost not changed while the filter-rod is being manufactured.

In addition, the tow 101 stretches by its own weight. In other words, in accordance with the progression of the filter-rod manufacturing process, the height H of the bale 102 from the floor 111 becomes lower, and the distance between the guide arm 103 and the surface of the bale 102 becomes larger, and the weight of the unsupported tow 101 between the guide arm 103 and the surface of the bale 102 becomes heavier. As a result, the degree of stretching of the crimp in the tow 101 becomes gradually larger.

On account of this phenomenon, as the tension in the tow 101 becomes larger and the amount of the tow drawn in the tow processing device 105 per unit time becomes smaller, a lighter weight filter-rod is produced.

After considering the change of the crimp condition of the tow 101 in the conventional filter-rod manufacturing device, the relation between the tension in the tow 101 in the first processing step and the weight of the filter-rod under the manufacturing process was determined by the following experiments.

EXPERIMENT 1

(1) Making of the filter-rod.

Type of machine used:

KDF2/AF1 (made by Hawni in Germany) processing condition: speed 400 m/min.

(2) Speed ratio of rollers.

speeds of pretension rollers (PT)/speeds of feed rollers (F)=0.5–0.7 speeds of feed rollers (F)/speeds of delivery rollers (D)=1.3 roller pressure pretension rollers (RTR)=1.0–1.8 feed rollers (FR)=1.0–1.8

(3) Tension-measuring device.

Tension meter; made by the Minibea Co.

type C261-20K type DSA-605C

The force occurring in the tow was measured as strains, and the strains are converted into electrical signals and recorded.

Figure 2:
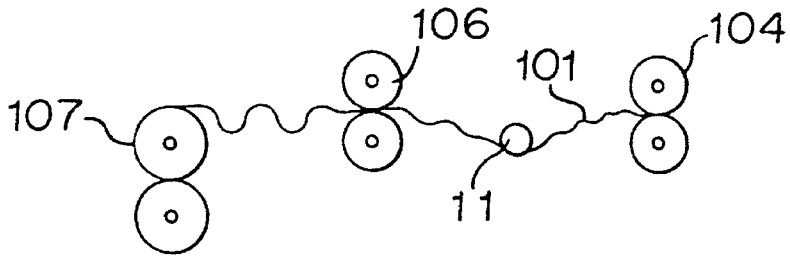
FIG. 2 is a summary drawing showing the installation location of the tension measuring device used in Experiment 1 of the present invention.

The tension meter was installed for the tension bar 11 to contact with the tension bar 11 placed between the pretension rollers 104 and the feed rollers 106 in the conventional cigarette filter-rod manufacturing device shown in FIG. 2.

(1) The tow and filter-rod;

The tow; 3Y-36,000 and 4Y-35,000 (each produced by Daicell Chemical Industry Co., Ltd.)

(2) The filter-rod;

102 mm (length)×24.7 mm (circumference).

(3) Measuring of the rod characteristics;

Weight; measured by the physical balance measurable decimal fractions up to three digits.

Pressure drop; measured by the test station "FTS-400" made by Filtroner Co. (England).

Definitions of each retained crimp ratio and their calculation formulas;

Retained crimp ratios (RCR), the final one in the rod called RCR and the ones at each of the rollers in the rod-making device are calculated with the following formula.

Formula 1, RCR=(NTW)×9000/(TD)×(L) wherein,

NTW: net tow weight, weight of the tow in respective filter-rod (g).

TD: total denier.

L: length of filter-rod

Formula 2, D·CR=(RCR)×(Vt/Vd) wherein,

DCR: retained crimp ratio on the delivery rollers.

Vd,Vt: linear speed of the delivery rollers and filter-rod body 109.

Formula 3, PT·CR=D·CR×(Vd/Vpt) wherein,

PT·CR: retained crimp ratio on the pretension rollers.

Vpt: linear speed of the pretension rollers.

Formula 4, F·CR=D·CR×(Vd/Vf) wherein,

F·CR: retained crimp ratio on the feed rollers.

$V_f$: linear speed of the feed roller.

By performing the experiment under the above conditions, the net tow weight in the filter-rod (NTW), the air pressure drop (PD), the retained crimp ratio in the filter rod and on each of the rollers (RCR, D·CR, F·CR, and PT·CR) and the tension of the tow (T) against height H of the tow bales in the conventional cigarette filter-rod manufacturing device are measured and the results obtained are shown in Table 1.

TABLE 1

| Bale height cm. | NTW g/rod | PD mmAq | RCR | D.CR | F.CR | PT.CR | T kg. |
|---|---|---|---|---|---|---|---|
| 120 | 0.555 | 305 | 1.358 | 1.151 | 0.855 | 1.450 | 2.59 |
| 90 | 0.550 | 301 | 1.346 | 1.141 | 0.877 | 1.437 | 2.65 |
| 60 | 0.544 | 290 | 1.336 | 1.131 | 0.870 | 1.426 | 2.72 |
| 30 | 0.536 | 275 | 1.299 | 1.101 | 0.847 | 1.387 | 2.82 |

Table 1 shows clearly that NTW has a difference more than and PD has a difference less than 10% between the top level of the position and the bottom level of the position of the tow bale.

Though Table 1 above shows the results of only an example of the tow processing condition, even if the relationships between the height H of the tow bale and each value of NTW and PD included the results obtained in the experiments performed with other operating conditions, the same linear relationships are recognized.

In each case, according to the decrease in the height H of the tow bale, each retained crimp ratio becomes linearly smaller and the tension in the tow 101 becomes linearly larger. It becomes possible to understand numerically that the tow is taken in the rod-making device while the crimp is gradually stretched owing to the weight of the unsupported tow 101 between the guide arm 103 and the surface of the bale 102. And as the speeds of the pretension rollers 104 and the feed rollers 106 are operated without change after the tow 101 is taken in, and D·CR and F·CR gradually become smaller in accordance with PT·CR and the crimp in the tow also becomes stretched, the tension in the tow gradually becomes larger.

The tension in the tow 101 being measured in this case indicates the conditions of the tow passing and being processed between the pretension rollers 104 and the feed rollers 106 (namely while the tow is processed in the first processing step). In other words, it is considered that the tension in the tow well reflects the condition of the crimp in the tow.

In view of the above, by continuously increasing the speed of the pretension rollers 104 so that the tension in the tow is kept constant (namely, the speed of the feed rollers 106 is kept constant as in the initial condition) and by taking the tow 101 in the tow processing device 105, it is predictable that the crimp in the tow 101 is able to recover its initial condition between the pretension rollers 104 and the feed rollers 106, and that it is possible to drive the processing operation under a constant retained crimp condition. Namely, it is supposed that the tow weight passing per unit time becomes constant.

EXPERIMENT 2

By applying the same experimental device used in experiment 1, the next experiment examined whether or not it is possible to obtain a filter-rod having constant weight and constant pressure drop, by keeping the tension in the tow constant while being processed in the rod-making device.

In the process of rod-making, one bale of the tow is processed while the speed of the pretension rollers (PTR) 104 is increased by hand while watching the tension in the tow.

Figure 3:
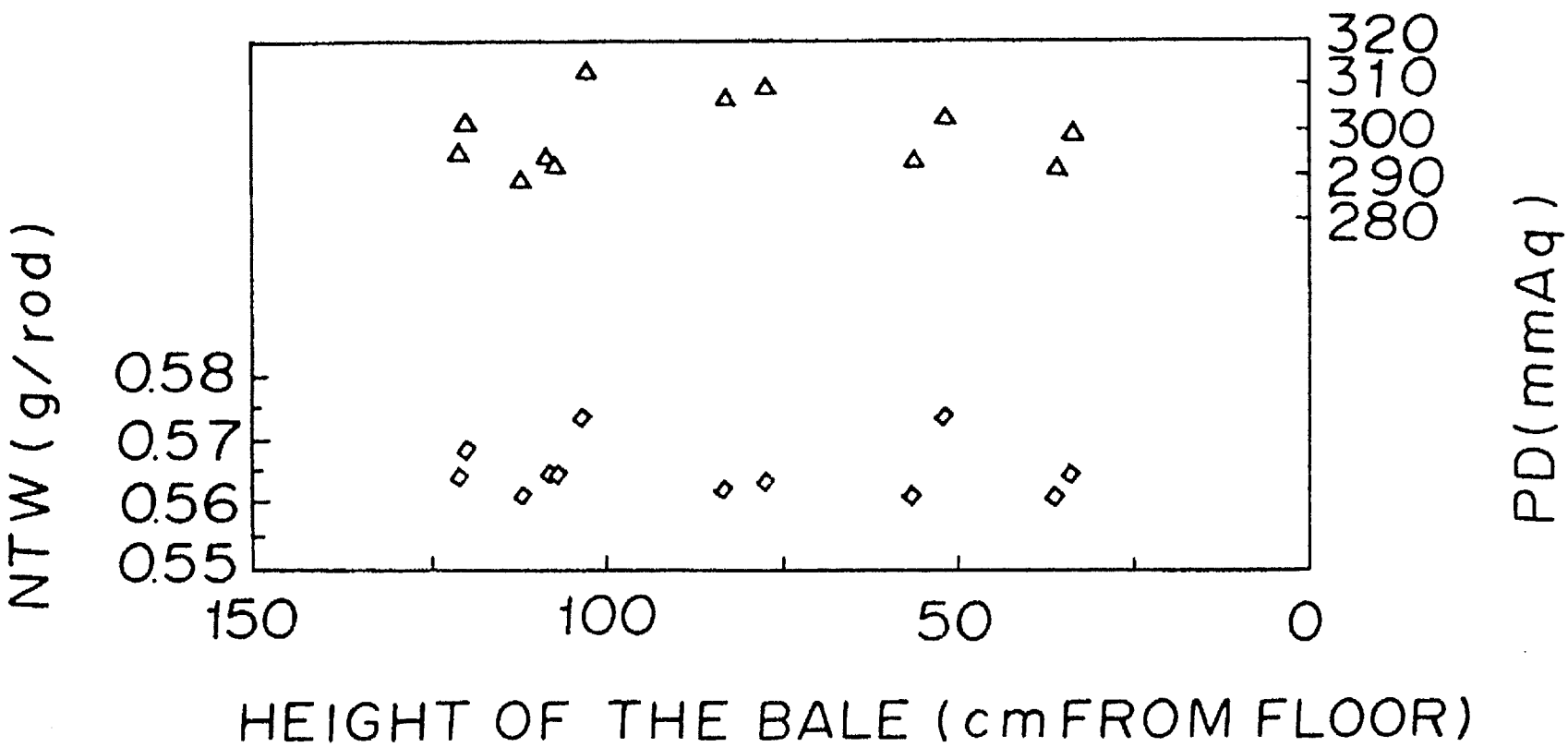
FIG. 3 is one graph showing the filter-rod characteristics obtained in Experiment 2 of the present invention.

FIG. 3 shows the plotted results of the weight of the tow in the product rod (NTW), and the pressure drop (PD) in reference to the height of the tow bales.

In looking at these results, it is possible to judge that NTW has a mean value of 0.565 and PD has mean value of 300 mmAq and these values are maintained in the practical definitive ranges.

Figure 4:
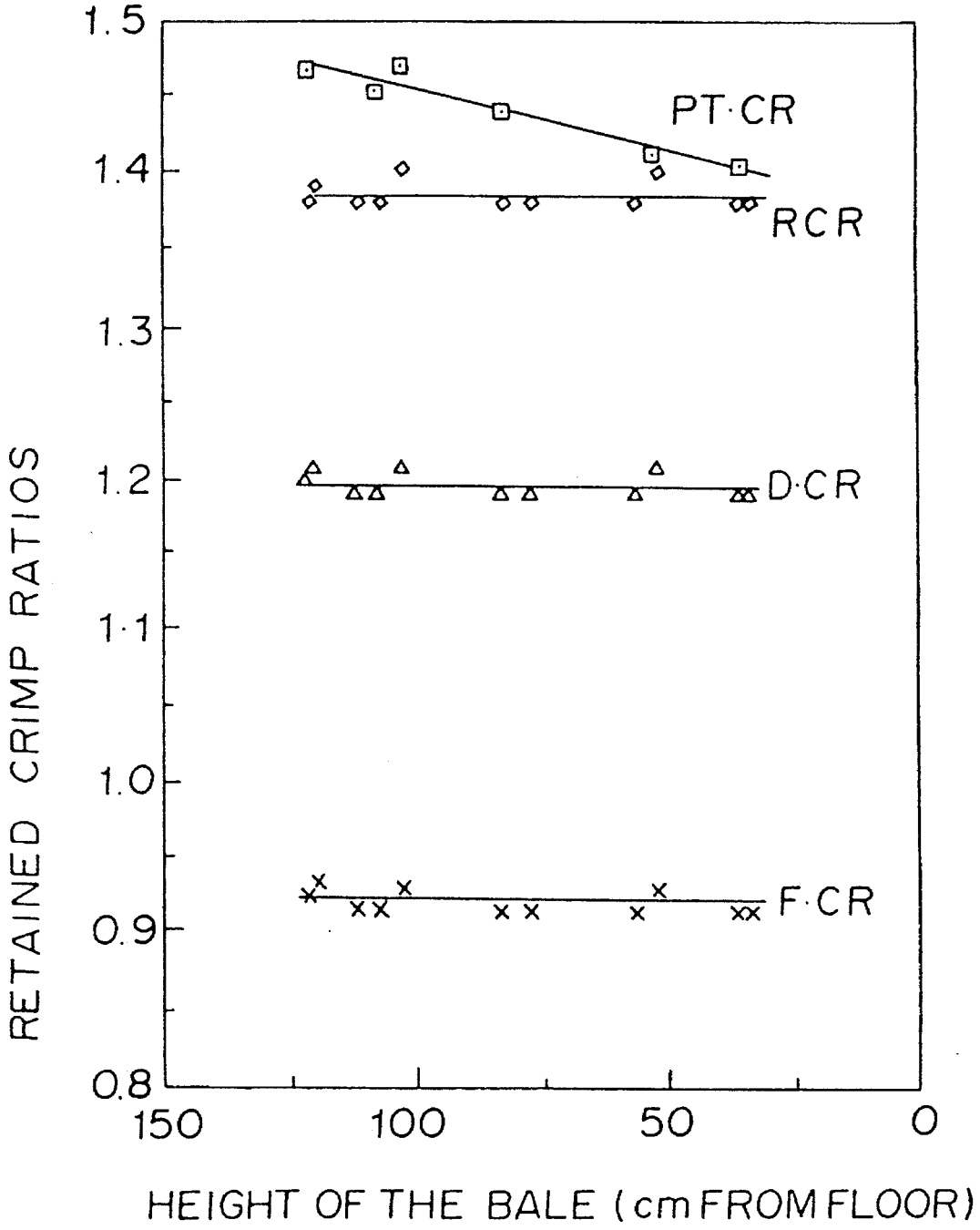
FIG. 4 is another graph showing the filter-rod characteristic obtained in Experiment 2 of the present invention.

In FIG. 4, the plotted results of RCR, D·CR, F·CR and PT·CR in reference to the height of the tow bale are shown.

In considering the condition of the tow in the rod-making device while viewing each retained crimp ratio, the following result is obtained. Namely, it is possible to consider that D·CR is the ratio of the retained crimp ratio between the delivery rollers 107 and the feed rollers 106, and F·CR is the retained crimp ratio between the feed rollers 106 and the pretension rollers 104, and PT·CR is the retained crimp ratio in the tow immediately before being taken in the pretension rollers 104. Based on this premise, further consideration develops as follows.

PT·CR, namely, the retained crimp ratio in the tow 101 before entering the pretension rollers 104 is changed linearly to the change of the height of bales so as being at almost the same value as in experiment 1.

This tendency is due to the tow being taken in the rod-making device while the crimp is stretched because of the weight of the tow being loaded the same as in experiment 1 in spite of the picking-up speed of the bale becoming gradually faster.

F·CR, namely, the retained crimp ratio between the feed rollers 106 and the pretension rollers 104 indicates the constant value. In addition to the result of the NTW shown in FIG. 3 being constant, it was verified that the consideration in experiment 1 is correct.

Figure 5:
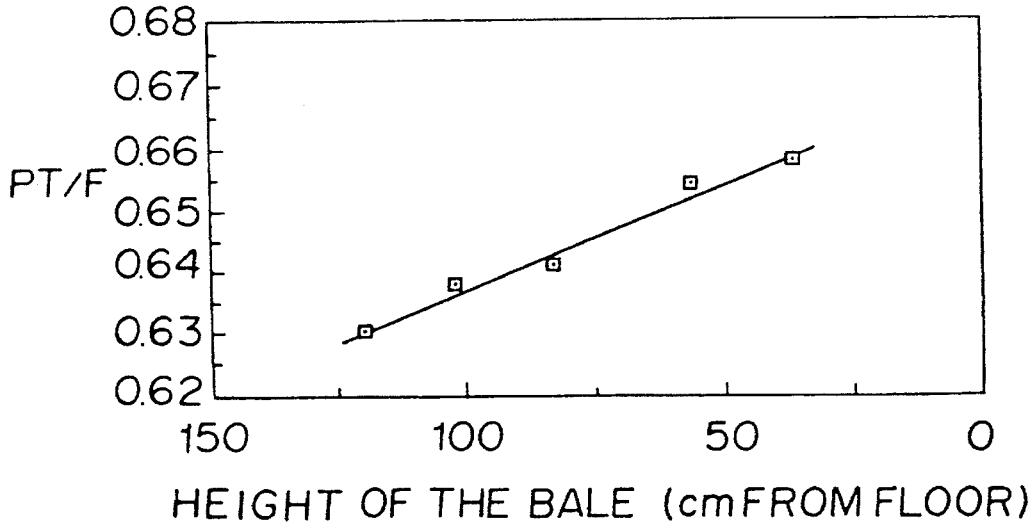
FIG. 5 is a graph showing the roller speed ratio between the pretension roller and the feed roller to the bale height in Experiment 2 of the present invention.

As the speed of the pretension rollers 104 is increased, and the rod-making device takes in the tow 101 having a constant weight per unit time (though the crimp is being stretched), and the speed of the feed rollers 106 stays constant and unchanged from the initial condition, the speed ratio between the pretension rollers 104 and the feed rollers 106 (PT/F) becomes gradually larger (shown in FIG. 5), the crimping returns to the original condition and at all times a constant retained crimp ratio is kept.

D·CR, namely, the retained crimp ratio between the delivery rollers 107 and the feed rollers 106 is also kept constant. This is due to the tow 101, having constant retained crimp ratio, being forced in the delivery rollers 107 from the feed rollers 106, and each speed of the feed rollers 106 and the delivery rollers 107 are kept constant while rod-making (accordingly, F/D is also kept constant). As a result, in considering the above, it was judged that it is possible to manufacture a filter-rod having a specified constant weight, by measuring the tension in the tow between the pretension rollers and the feed rollers 106, and by taking the tow 101 into the rod-making device by increasing the speed of the pretension rollers 104 so as to keep the tension in the tow 101 during rod-making.

The control program stored in the microcomputer 23 in the embodiment according to the present invention is comprised so that the driving system of the mechanical control section 2 successively increases the revolving speed of the pretension rollers 104 in accordance with the increase in strain of the tension gauge 1, by applying the results obtained in the above experiment 2.

The device according to this embodiment uses the tension measuring device applied to experiment 1 as the tension gauge 1, and the exchanging switch 30 is automatized.

The device was automatically operated under the rod-making condition set up in experiment 1 by applying a 4Y-35000 tow made by Daicell Chemical Industries Co., Ltd.

Figure 6:
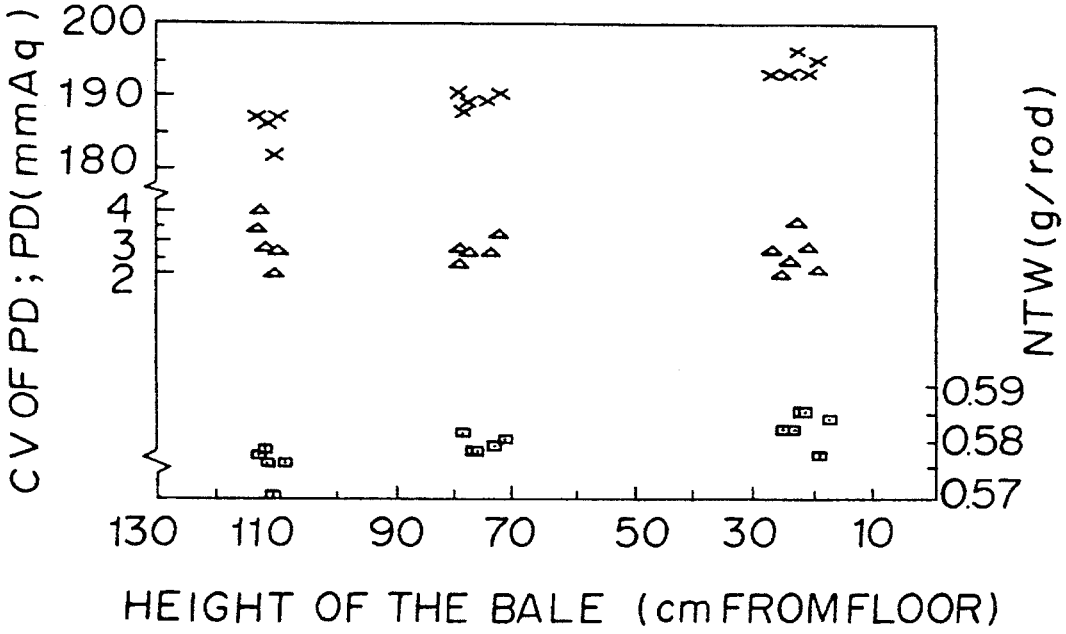
FIG. 6 is a graph showing the filter-rod characteristics obtained in the embodiment according to the present invention.
Figure 7:
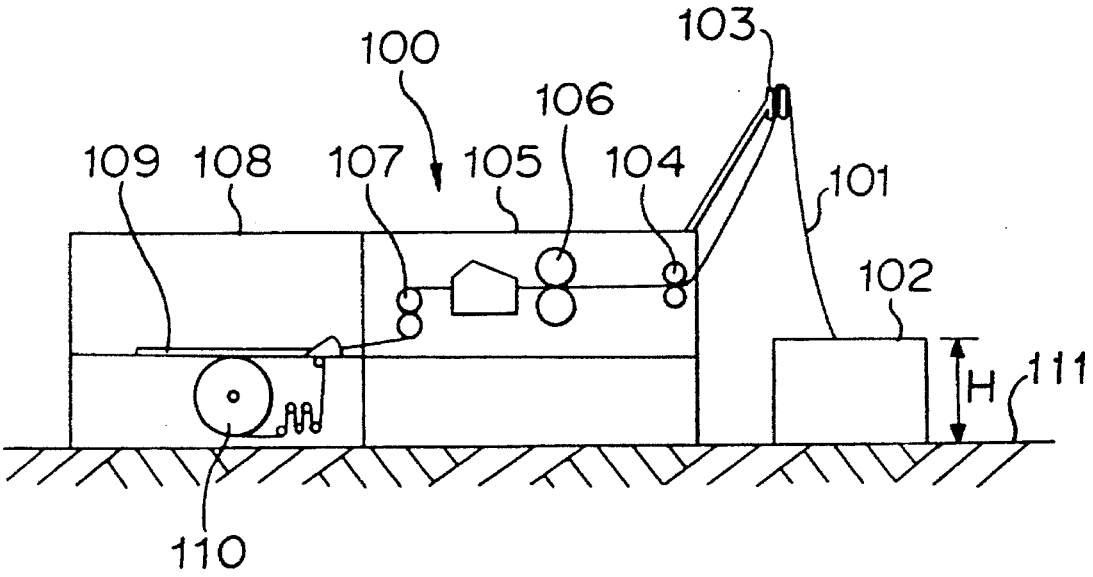
FIG. 7 (PRIOR ART)
FIG. 7 shows the summary of a conventional filter-rod manufacturing device for cigarettes.

The characteristic properties obtained in this operation are shown in FIG. 6.

As FIG. 6 clearly shows, the rod weight, the pressure drop (PD) and the variational coefficient of the PD (CV value in PD) in reference to the height of the rod bales are all in the usual allowance of the quality control range and it was possible to automatically and continuously manufacture a filter- rod having a specified constant weight by applying the device according to this embodiment.

As previously described in detail, because the automatized weight control device for cigarette filter-rods according to the embodiment of the present invention is comprised of the tension gauge measuring the tension in the tow, and the control system which increases the speed of the pretension rollers by applying the signals transformed from the tension gauge through the microcomputer, it is possible to provide a cigarette filter-rod manufacturing device able to easily automate the manufacturing process by adding the device to existing manufacturing facilities, and to produce a cigarette filter-rod having specified constant characteristic properties without requiring any special qualifications or experience for operating the device.

What is claimed is:

1. In an apparatus for manufacturing cigarette filters, incorporating an improved automatic weigh control device; and having a tow processing device, a pair of pretension rollers, a pair of feed rollers, a pair of delivery rollers, a guide arm located above a tow bale, and which performs a first processing step including drawing tow into said tow processing device from said pretension rollers through said guide arm and stretching said tow between said pretension rollers and said feed rollers, and a second processing step including relaxing said tow between said feed rollers and said delivery rollers: said improved automatic weight control device of said apparatus comprising:

a microcomputer; a tension gauge for measuring tension of said tow in said first processing step; and a tow tension control means for regulating the tension of said tow at a predetermined constant level in said first processing step by increasing the speed of the said pretension rollers based on signals generated by said tension gauge so that the tension in said tow is maintained substantially constant and said signals are converted to electrical signals and automatically processed by said microcomputer for controlling the tow stretching in said first processing step; and said tow tension control means being provided with a load cell for transforming strains measured by said tension gauge to electric signals; an A-D converter converting said electric signals of said load cell to digital signals; and said microcomputer having a predetermined control program; and a pulse motor and a pulse motor controller operated by said microcomputer, and a speed changer for increasing rotational speed of said pair of pretension rollers, said speed changer being driven through the pulse motor controller activated by said microcomputer, said pulse motor being driven by signals received from said pulse motor controller;

and a speed reduction gear, electromagnetic clutch, and connecting gear, said_ speed reduction gear being connected between said clutch and connecting gear; whereby substantially all cigarette filter-rods made by said apparatus have a uniform specified weight.

2. The automatic weight control device as claimed in claim 1, further including a switch in said tow tension control means for changing to a manual operational mode.

3. The automatic weight control device as claimed in claim 2, including a hand-operated speed changing knob directly coupled to said connecting gear for manually adjusting said tow tension control means.

* * * * *